United States Patent [19]

Kessler

[11] 3,961,751

[45] June 8, 1976

[54] ARTIFICIAL CROSS-COUNTRY SKIING PATH

[75] Inventor: Jean Kessler, Grenoble, France

[73] Assignee: Societe Kessler S.A., Grenoble, France

[22] Filed: Mar. 27, 1975

[21] Appl. No.: 562,854

[30] Foreign Application Priority Data

Mar. 29, 1974 France ..... 74.11824

[52] U.S. Cl. ..... 238/10 R; 272/56.5 SS

[51] Int. Cl.[2] ..... E01B 23/00

[58] Field of Search ..... 272/56.5 SS, 56.5 R; 104/134, 136, 53, 62, 69, 87; 238/10 R, 14

[56] References Cited

UNITED STATES PATENTS

| | | | |
|---|---|---|---|
| 344,704 | 6/1886 | Whiteley | 272/56.5 SS UX |
| 488,371 | 12/1892 | Smith | 238/14 X |
| 3,233,893 | 2/1966 | Meyer | 272/56.5 SS |
| 3,363,583 | 1/1968 | Greenberg | 272/56.5 SS X |
| 3,385,229 | 5/1968 | Ahern | 272/56.5 SS X |
| 3,406,617 | 10/1968 | Randazzo | 272/56.5 SS X |
| 3,443,493 | 5/1969 | Del Piano et al. | 272/56.5 SS X |
| 3,557,668 | 1/1971 | See | 272/56.5 SS |
| 3,809,391 | 5/1974 | See | 272/56.5 SS |

FOREIGN PATENTS OR APPLICATIONS

| | | | |
|---|---|---|---|
| 1,412,411 | 8/1965 | France | 272/56.5 SS |
| 2,043,394 | 4/1972 | Germany | 272/56.5 SS |
| 244,863 | 10/1946 | Switzerland | 104/134 |

*Primary Examiner*—Richard C. Pinkham
*Assistant Examiner*—Arnold W. Kramer
*Attorney, Agent, or Firm*—Karl F. Ross; Herbert Dubno

[57] ABSTRACT

A cross-country skiing path has a pair of side-by-side elongated tracks each formed as an upwardly open and longitudinally extending channel in turn each formed of a longitudinal succession of separate track elements that each have a separate web and inside and outside flanges flanking this web. Each inside flange of each element of each row is turned toward an inside flange of a corresponding element of the other row and is provided with an ear extending toward the other row and having a longitudinal length equal to approximately half the overall longitudinal length of the element. Each ear is longitudinally offset from the corresponding ear of the corresponding element of the other row and extends transversely beyond the longitudinal midline of the path. An elongated longitudinally extending connector member, such as a cable, passes through the ears at the midline and interconnects the elements into a chain. Similar connecting members extend through the outside flanges.

10 Claims, 4 Drawing Figures

ARTIFICIAL CROSS-COUNTRY SKIING PATH

FIELD OF THE INVENTION

The present invention relates to a ski path. More particularly this invention concerns an artificial ski path usable in the absence of snow for cross-country skiing.

BACKGROUND OF THE INVENTION

In order to allow enthusiasts of skiing to exercise and practice at times when there is no snow or insufficient snow, recourse has been had to so-called artificial ski paths. One such path (see French Pat. 2,172,916) is formed as a chain of like track elements. Each track element is generally W-shaped in cross section and therefore forms a path having a pair of parallel ruts along which the skiier slides his skis. These track elements are made of polyvinyl chloride and are secured together by rods, cables or ropes so as to form a chain that can conform its shape generally to that of the terrain over which it is lain.

It is also known to use such an artificial path on a ski jump (see German Pat. No. 2,043,395). Depending on the type of connector member used to chain together the individual track elements, such ski paths are laid either as sections which are secured together or are simply rolled out (see French Pat. No. 1,349,398 and U.S. Pat. No. 3,233,893).

OBJECTS OF THE INVENTION

It is an object of the present invention to provide an improved ski path.

Another object is the provision of such a ski path which is able to conform to the terrain over which it is lain more closely than the prior-art ski paths.

Yet another object is to provide a ski path which closely duplicates snow-skiing conditions and is usable for simulating cross-country skiing on snow.

SUMMARY OF THE INVENTION

These objects are attained according to the present invention in a ski path comprising a pair of side-by-side elongated tracks each formed as an upwardly open and longitudinally extending ski-receiving channel in turn each formed of a longitudinal succession of separate track elements. Each such element has a central web and inside and outside flanges flanking the web. Each inside flange of each element of each row is turned toward an inside flange of a corresponding element of the other row and is provided with an ear extending toward the other row and having a longitudinal length shorter than the overall longitudinal length of the element. Each ear is longitudinally offset from the corresponding ear of the corresponding element of the other row and extends transversely beyond a longitudinal midline of the path that extends generally longitudinally of a path between the rows. An elongated longitudinally extending connector member passes through the ears at the midline and interconnects the elements into a chain.

Thus the path according to the present invention can conform exactly to irregularities in terrain, flexing both longitudinally and transversely. In this manner the path more closely duplicates actual skiiing conditions than the paths known hitherto. In addition in the problem of an individual track element rocking to one side or the other, as a result of a protruding object lying under the center of the element, is avoided.

According to another feature of this invention each of the ears through which the central connecting member passes has a longitudinal length equal to no more than half, and preferably about half, of the longitudinal length of the respective elements. Thus the elements are all absolutely identical.

In accordance with yet another feature of this invention two outside connector members are provided which each pass longitudinally through the outside flanges of a respective row. In this manner an extremely rugged yet flexible assembly is provided.

According to a further feature of this invention the elements are longitudinally separated by spacers which reduce the cost per unit length of the path while allowing it to be rolled up more easily, and in no way impair the skiing characteristics of the path. These spacers can be formed as short rigid tubes through which the connecting members pass between the elements.

BRIEF DESCRIPTION OF THE DRAWING

The above and other objects, features, and advantages, will become more readily apparent from the following, reference being made to the accompanying drawing in which.

SPECIFIC DESCRIPTION

Figure 1:
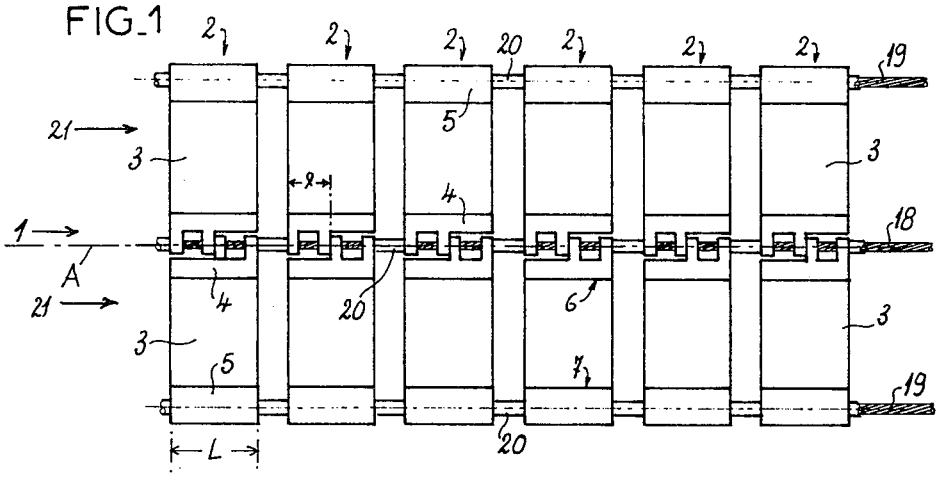
FIG. 1 is a top view of a section of the path according to the present invention.
Figure 2:
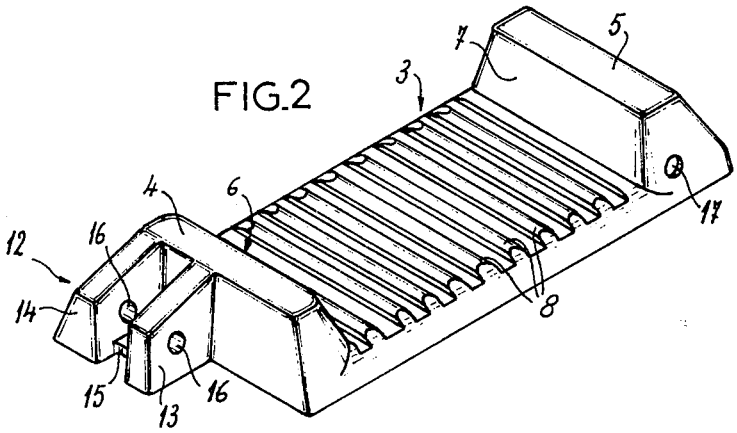
FIG. 2 is a perspective view of a track element of the path according to this invention.
Figure 3:
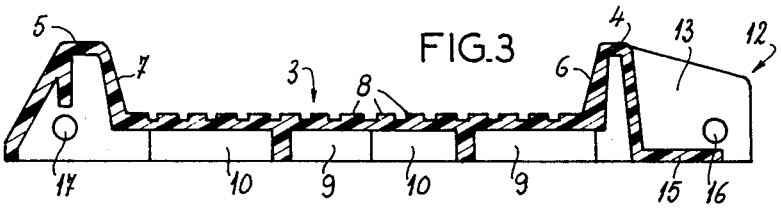
FIG. 3 is a section through the element of FIG. 2 taken in a direction of the path of FIG. 1.

A ski path 1 according to the present invention has a pair of like rows 21 formed of a succession of like polyvinyl chloride track elements 2 arranged one after another in the longitudinal direction A of the path 1. Each of these elements 2 as shown in FIGS. 2 and 3 comprises a generally flat central web 3 flanked by an inside flange 4 and an outside flange 5, with the inside flanks 6 and 7 of the flanges 4 and 5 forming a downwardly tapered trapezoidal-section channel. The web is formed with a multiplicity of longitudinally extending ribs 8 which are substantially one third as high as they are wide and serve to decrease the coefficient of friction of the ski sliding along the row. On its bottom side the web is formed with criss-crossing ribs 9 and 10 that serve to rigidify the individual element 2.

Figure 4:
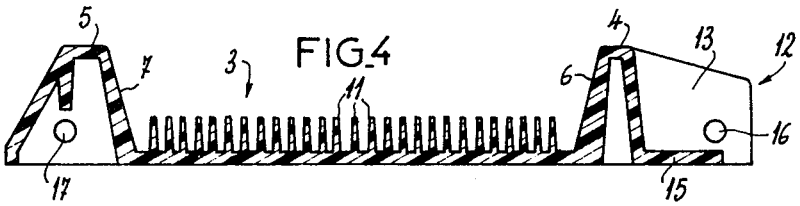
FIG. 4 is a view similar to FIG. 3 showing another type of element according to this invention.

The arrangement shown in FIG. 4 dispenses with stiffening ribs 9 and 10 and has a simple flat web 3' provided with a multiplicity of upstanding spines 11 whose lengths are a multiple, here 4 times, their diameter. This arrangement is capable of deforming readily to match the terrain, and has an extremely low coefficient of friction.

The inside flange 4 of each or the elements 2 is formed with an ear 12 having an overall length l equal to exactly half of the overall length L of the element. This ear 12 is formed by a pair of molded tabs 13 and 14 interconnected by a web 15 contiguous with the planar bottom surface of the element 2 and the two tabs 13 and 14 are formed with in line throughgoing holes 16. The outside flange 5 is similarly formed at the end surfaces of the element 2 with in line holes 17.

In the assembled structure a connector member 18, which can be a rod, a wire, a synthetic-resin rope, or the like is passed through the holes 16. Since the ears 12 extend beyond the midline of axis A of path 1 and these holes 16 are all aligned with this axis A the element 18 therefore joins together all of the elements 2. Short tubes 20 having an overall length equal to approximately one third of the length L are provided between longitudinally succeeding pairs of elements 2 so as to space them apart. Further connector elements 19 are passed through the holes 17 with further spacers 20 provided here also.

In this manner a flexible yet very strong path is formed which conforms readily to the underlying terrain. The ability of the assembly to flex about the central axis A allows it to lie flat even on relatively rough terrain so as to accurately reproduce normal snow-skiing conditions. As the device is made of a durable synthetic-resin it can be left out year round, being used in the summer when there is no snow, and being harmlessly covered by snow in the winter. This particular use is advantageous in situations where snow cover is not complete so that cross-country skiing can be conducted over areas only partly covered with snow, skiing across the uncovered areas on the uncovered path.

I claim:

1. A ski path comprising:

a pair of side-by-side rows of elongated tracks each formed as an upwardly open and longitudinally extending channel in turn each formed of a longitudinal succession of separate similar track elements each having a central web and inside and outside flanges upstandingly higher than and flanking said web, each inside flange of each element of each row being turned toward an inside flange of a corresponding element of the other row and being provided with an ear extending toward said other row and having a longitudinal length shorter than the overall longitudinal length of the element, each ear being longitudinally offset from the corresponding ear of the corresponding element of the other row and extending transversely beyond a longitudinal midline of said path extending generally between said rows; and an elongated longitudinally extending connector member passing through said ears at said midline and interconnecting said corresponding elements in side-by-side relation into a chain with the upstanding flanges and webs of each side forming one of said channels.

2. The path defined in claim 1 wherein each ear has a longitudinal length equal to no more than half of the longitudinal length of the respective element.

3. The path defined in claim 2 wherein each ear has a longitudinal length substantially equal to half of the longitudinal length of the respective element.

4. The path defined in claim 3, further comprising a pair of outer connector members each passing longitudinally through the outer flanges of a respective row.

5. The path defined in claim 4, further comprising a plurality of spacers each between two neighboring elements and abutting same to maintain a minimum longitudinal spacing therebetween.

6. The path defined in claim 5, wherein said spacers are carried on at least one of said connector members.

7. The path defined in claim 6, wherein said one member is the first-mentioned member extending through said ears.

8. The path defined in claim 6, wherein said spacers are tubes, said one member passing through said tubes.

9. The path defined in claim 8, wherein said elements each have a longitudinal length equal to between one-quarter and one-third of the transverse length of said elements.

10. The path defined in claim 1 wherein said elements are each formed at the upper portion of said web with an array of longitudinally extending ridges.

* * * * *